US011257455B2

(12) United States Patent
Xiong et al.

(10) Patent No.: US 11,257,455 B2
(45) Date of Patent: Feb. 22, 2022

(54) GATE DRIVE CIRCUIT AND DISPLAY PANEL

(71) Applicant: Shenzhen China Star Optoelectronics Semiconductor Display Technology Co., Ltd., Guangdong (CN)

(72) Inventors: Jue Xiong, Guangdong (CN); Ilgon Kim, Guangdong (CN); Bin Zhao, Guangdong (CN); Xin Zhang, Guangdong (CN); Jun Zhao, Guangdong (CN)

(73) Assignee: Shenzhen China Star Optoelectronics Semiconductor Display Technology Co., Ltd., Guangdong (CN)

( * ) Notice: Subject to any disclaimer, the term of this patent is extended or adjusted under 35 U.S.C. 154(b) by 0 days.

(21) Appl. No.: 16/766,760

(22) PCT Filed: Apr. 21, 2020

(86) PCT No.: PCT/CN2020/085983

§ 371 (c)(1),
(2) Date: May 26, 2020

(87) PCT Pub. No.: WO2021/189576

PCT Pub. Date: Sep. 30, 2021

(65) Prior Publication Data

US 2021/0295795 A1 Sep. 23, 2021

(30) Foreign Application Priority Data

Mar. 22, 2020 (CN) ..... 202010204840.5

(51) Int. Cl.
*G09G 3/36* (2006.01)

(52) U.S. Cl.
CPC ..... *G09G 3/3677* (2013.01); *G09G 2310/08* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,489,888 | B2 * | 11/2016 | Kim | G09G 3/3233 |
| 10,559,597 | B1 * | 2/2020 | Li | G09G 3/20 |
| 2007/0146276 | A1 | 6/2007 | Syu et al. | |
| 2014/0269782 | A1 * | 9/2014 | Ahn | H04L 7/0016 370/516 |

(Continued)

FOREIGN PATENT DOCUMENTS

| | | | |
|---|---|---|---|
| CN | 103745707 | A | 4/2014 |
| CN | 104992682 | A | 10/2015 |

(Continued)

*Primary Examiner* — Van N Chow
(74) *Attorney, Agent, or Firm* — Mark M. Friedman

(57) ABSTRACT

A gate drive circuit and a display panel are provided. The gate drive circuit includes N clock signal lines and a plurality of gate drive units. Each of the gate drive units is connected to at least one of the clock signal lines. Each of the clock signal lines is provided with a capacitance compensation unit, a sum of an area of any one of the clock signal lines and an area of the capacitance compensation unit provided on the same clock signal line is equal to a predetermined area, and N is an integer greater than or equal to 2.

18 Claims, 3 Drawing Sheets

(56) References Cited

U.S. PATENT DOCUMENTS

| | | | | |
|---|---|---|---|---|
| 2015/0316825 | A1* | 11/2015 | Lim | G02F 1/13439 257/72 |
| 2015/0379951 | A1 | 12/2015 | Zeng | |
| 2017/0004795 | A1 | 1/2017 | Dai | |
| 2017/0256217 | A1* | 9/2017 | Xiao | G09G 3/3677 |
| 2018/0357946 | A1* | 12/2018 | Ryu | G09G 3/006 |
| 2019/0131360 | A1* | 5/2019 | Lee | G09G 3/3233 |
| 2019/0245095 | A1* | 8/2019 | Tsai | G09F 9/30 |
| 2021/0027704 | A1* | 1/2021 | Tong | G09G 3/3225 |
| 2021/0201783 | A1* | 7/2021 | Oh | G09G 3/3233 |
| 2021/0210017 | A1* | 7/2021 | Feng | G11C 19/287 |

FOREIGN PATENT DOCUMENTS

| | | | |
|---|---|---|---|
| CN | 105047158 | A | 11/2015 |
| JP | 2006119449 | A | 5/2006 |

* cited by examiner

GATE DRIVE CIRCUIT AND DISPLAY PANEL

FIELD OF INVENTION

The present invention relates to the field of display technologies, and more particularly to a gate drive circuit and a display panel.

BACKGROUND OF INVENTION

At present, 1G1D 8K products generally use a gate drive circuit (gate on Array). However, scan lines and data lines of 1G1D 8K products have large RC loading and short charging time. Scan signals loaded on the scan lines of the 1G1D 8K products are extremely sensitive to a capacitance difference between multiple clock signal lines (CLOCK) in the gate drive circuit. A large capacitance difference between different clock signal lines will cause a difference in a scan signal waveform loaded on the scan line corresponding to the clock signal line. 1G1D 8K products have display issues such as horizontal lines with equal spacing.

Therefore, it is necessary to propose a technical solution to solve an image display issue caused by a large capacitance difference between different clock signal lines.

SUMMARY OF INVENTION

An object of the present application is to provide a gate drive circuit and a display panel to balance falling time of a scan signal output by a gate drive unit connected to a plurality of clock signal lines of the gate drive circuit to avoid differences in capacitances of the clock signal lines that cause the display panel to have horizontally dense lines and uneven brightness.

In order to achieve the above object, an embodiment of the present application provides a gate drive circuit comprising N clock signal lines and a plurality of gate drive units. The N clock signal lines comprise a first clock signal line to an Nth clock signal line sequentially arranged on a side of the plurality of gate drive units, each of the gate drive units is connected to at least one of the clock signal lines. Each of the clock signal lines is provided with a capacitance compensation unit, an area of the capacitance compensation unit provided on the first clock signal line to an area of the capacitance compensation unit provided on the Nth clock signal line increases or decreases, a sum of an area of any one of the clock signal lines and an area of the capacitance compensation unit provided on the same clock signal line is equal to a predetermined area, and N is an integer greater than or equal to 2.

In the above gate drive circuit, the predetermined area is equal to an area of the Nth clock signal line, the first clock signal line is close to the plurality of the gate drive units, and the Nth clock signal line is away from the plurality of gate drive units.

In the above gate drive circuit, each of the gate drive units has at least one blank area, and the capacitance compensation unit on the clock signal line connected to each gate drive unit is disposed in the blank area of a corresponding gate drive unit.

In the above gate drive circuit, the plurality of the gate drive units are arranged in the same row, and the capacitance compensation units provided in the blank area in the plurality of gate drive units are arranged in the same row.

In the above gate drive circuit, each of the gate drive units comprises a wire, the wire has a pull-up node, and a distance between the capacitance compensation unit and the wire is greater than or equal to a predetermined distance.

In the above gate drive circuit, the predetermined distance is 10 microns.

In the above gate drive circuit, the capacitance compensation unit is a metal block disposed in the same layer as the clock signal line and connected in parallel with the clock signal line.

In the above gate drive circuit, each of the clock signal lines comprises a resistance compensation unit, and resistance values of any two of the clock signal lines from the first clock signal line to the Nth clock signal line are equal.

In the above gate drive circuit, a resistance value of the resistance compensation unit in the first clock signal line to a resistance value of the resistance compensation unit in the Nth clock signal line increases or decreases.

In the above gate drive circuit, each of the clock signal lines comprises a clock signal main line and at least one clock signal branch line extending from one of the clock signal main lines, each of the clock signal branch line is connected between one of the clock signal main lines and one of the gate drive units, the clock signal main line of the first clock signal line to the clock signal main line of the Nth clock signal line are sequentially disposed on a side of the plurality of gate drive units, and each of the clock signal branch lines is provided with the capacitance compensation unit.

A display panel comprises an array substrate. The display panel has a non-display area, a portion of the non-display area corresponding to the array substrate is provided with a gate drive circuit. The gate drive circuit comprises N clock signal lines and a plurality of gate drive units. The N clock signal lines comprise a first clock signal line to an Nth clock signal line sequentially arranged on a side of the plurality of gate drive units, each of the gate drive units is connected to at least one of the clock signal lines. Each of the clock signal lines is provided with a capacitance compensation unit, an area of the capacitance compensation unit provided on the first clock signal line to an area of the capacitance compensation unit provided on the Nth clock signal line increases or decreases, a sum of an area of any one of the clock signal lines and an area of the capacitance compensation unit provided on the same clock signal line is equal to a predetermined area, and N is an integer greater than or equal to 2.

In the above display panel, the predetermined area is equal to an area of the Nth clock signal line, the first clock signal line is close to the plurality of the gate drive units, and the Nth clock signal line is away from the plurality of gate drive units.

In the above display panel, each of the gate drive units has at least one blank area, and the capacitance compensation unit on the clock signal line connected to each gate drive unit is disposed in the blank area of a corresponding gate drive unit.

In the above display panel, the plurality of the gate drive units are arranged in the same row, and the capacitance compensation units provided in the blank area in the plurality of gate drive units are arranged in the same row.

In the above display panel, each of the gate drive units comprises a wire, the wire has a pull-up node, and a distance between the capacitance compensation unit and the wire is greater than or equal to a predetermined distance.

In the above display panel, the predetermined distance is 10 microns.

In the above display panel, the capacitance compensation unit is a metal block disposed in the same layer as the clock signal line and connected in parallel with the clock signal line.

In the above display panel, each of the clock signal lines comprises a resistance compensation unit, and resistance values of any two of the clock signal lines from the first clock signal line to the Nth clock signal line are equal.

In the above display panel, a resistance value of the resistance compensation unit in the first clock signal line to a resistance value of the resistance compensation unit in the Nth clock signal line increases or decreases.

In the above display panel, each of the clock signal lines comprises a clock signal main line and at least one clock signal branch line extending from one of the clock signal main lines, each of the clock signal branch line is connected between one of the clock signal main lines and one of the gate drive units, the clock signal main line of the first clock signal line to the clock signal main line of the Nth clock signal line are sequentially disposed on a side of the plurality of gate drive units, and each of the clock signal branch lines is provided with the capacitance compensation unit.

Beneficial Effect:

An embodiment of the present application provides gate drive circuit and a display panel. The gate drive circuit comprises N clock signal lines and a plurality of gate drive units. The N clock signal lines comprise a first clock signal line to an Nth clock signal line sequentially arranged on a side of the plurality of gate drive units, each of the gate drive units is connected to at least one of the clock signal lines. Each of the clock signal lines is provided with a capacitance compensation unit, an area of the capacitance compensation unit provided on the first clock signal line to an area of the capacitance compensation unit provided on the Nth clock signal line increases or decreases, a sum of an area of any one of the clock signal lines and an area of the capacitance compensation unit provided on the same clock signal line is equal to a predetermined area, and N is an integer greater than or equal to 2. By compensating for differences in areas between multiple clock signal lines, a sum of the area of each clock signal line and the area of the capacitance compensation unit connected to the same clock signal line is equal. Each clock signal line and the capacitance compensation unit connected to the same clock signal line are equal to a capacitance formed by a conductive layer on a color filter substrate side of the display panel. This balances falling time of a scan signal output by the gate drive unit connected to each clock signal line, avoids the difference in the capacitance of the clock signal line to cause horizontal dense lines and uneven brightness of the display panel, and avoids image quality issues on a 1G1D 8K display panel and improve display quality.

DETAILED DESCRIPTION OF PREFERRED EMBODIMENTS

The technical solutions in the embodiments of the present application will be described clearly and completely with reference to the drawings in the embodiments of the present application. Obviously, the described embodiments are only a part of the embodiments of the present application, but not all the embodiments. Based on the embodiments in the present application, all other embodiments obtained by those skilled in the art without making creative efforts fall within the protection scope of the present application.

Figure 1:
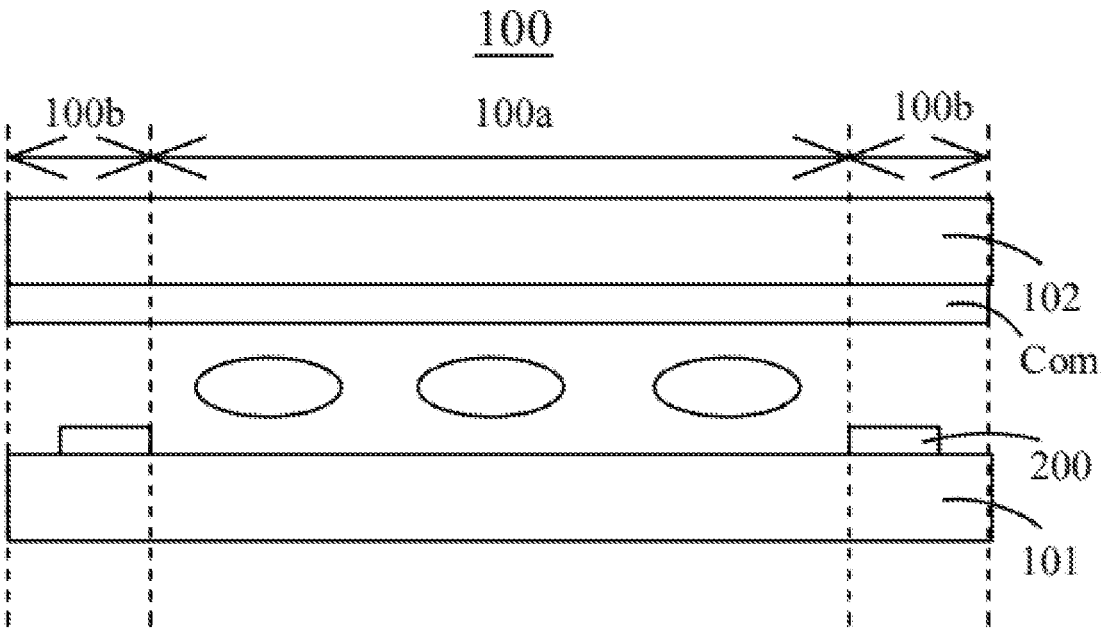
FIG. 1 is a schematic diagram of a display panel according to an embodiment of this application.
Figure 2:
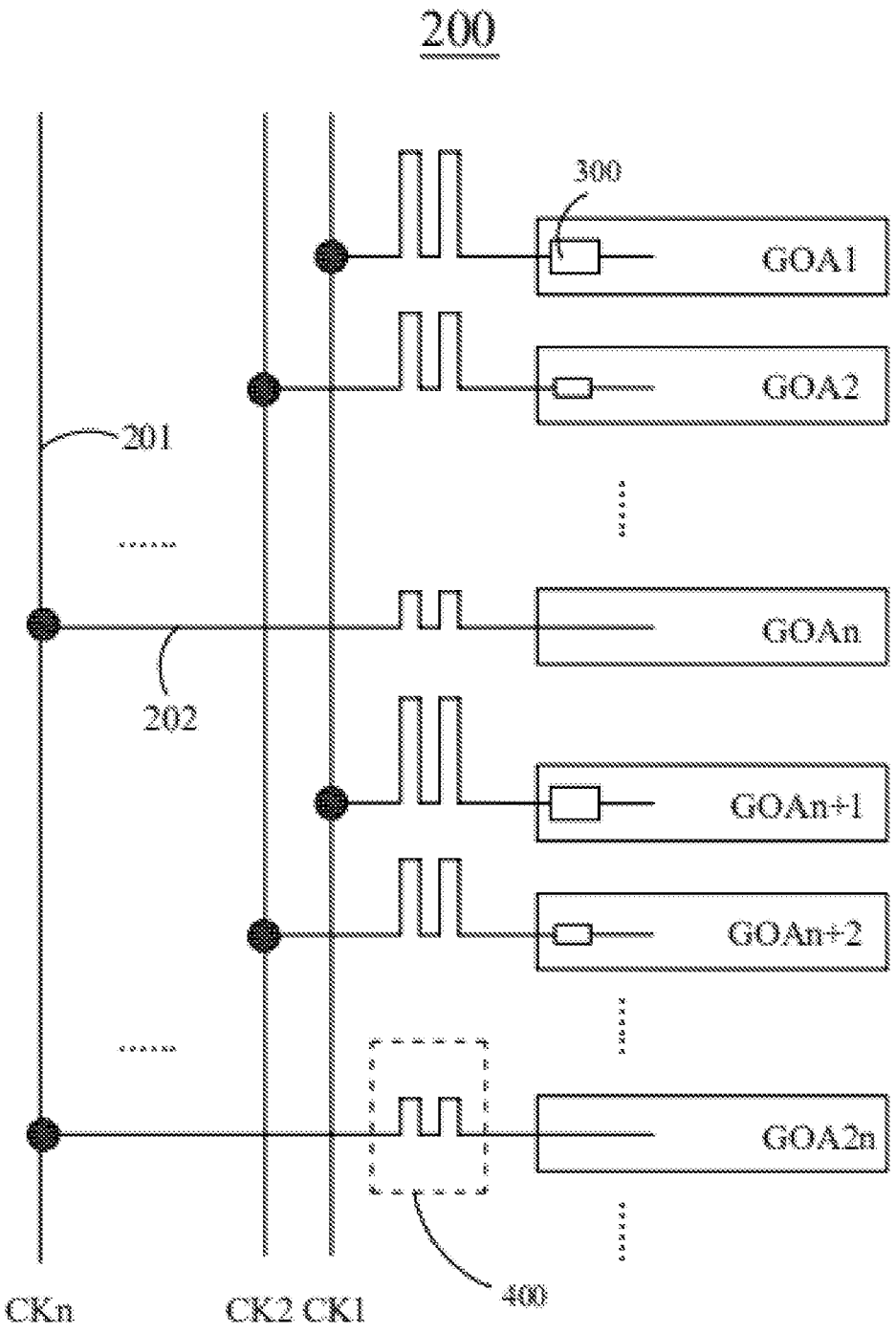
FIG. 2 is a first schematic diagram of a gate drive circuit in the display panel shown in FIG. 1.

Referring to FIG. 1 and FIG. 2, FIG. 1 is a schematic diagram of a display panel according to an embodiment of this application, and FIG. 2 is a first schematic diagram of a gate drive circuit in the display panel shown in FIG. 1. A display panel 100 is a liquid crystal display panel. The display panel 100 includes an array substrate 101, a color filter substrate 102, and a liquid crystal layer disposed between the array substrate 101 and the color filter substrate 102.

The display panel 100 has a display area 100*a* and a non-display area 100*b* located on a periphery of the display area 100*a*. The display area 100 a is provided with a plurality of scan lines S (not shown) arranged in parallel and data lines D (not shown) perpendicularly crossing the plurality of scan lines S. A sub-pixel is provided in an area defined by two adjacent scan lines S and two adjacent data lines D. The same row of sub-pixels are connected to the same scan line S to load scan signals. The sub-pixels in the same column are connected to the same data line D to load data signals. A portion of the non-display area 100*b* corresponding to the array substrate 101 is provided with a gate drive circuit 200 to input a scan signal to the scan line S in the display area 100*a*. A full-surface common electrode Com is provided on a surface of the color filter substrate 102 opposite to the array substrate 101. Liquid crystal molecules in a liquid crystal layer are deflected under action of a common voltage loaded by the common electrode Com and a pixel voltage loaded by the pixel electrode (not shown) on the array substrate 101, so as to realize bright and dark display of the sub-pixels.

As shown in FIG. 2, the gate drive circuit 200 includes N clock signal lines CK and a plurality of gate drive units GOA, N is an integer greater than or equal to 2. N clock signal lines CK are used to transmit clock signals. The N clock signal lines include a first clock signal line CK1 to an Nth clock signal line CKn that are sequentially provided on one side of the plurality of gate drive units GOA. Each clock signal line CK and the common electrode Com on the color filter substrate 102 constitute a capacitor.

In an embodiment, each clock signal line CK includes one clock signal main line 201 and at least one clock signal branch line 202 extending from one clock signal main line 201. Each clock signal branch line 202 is connected between one clock signal main line 201 and one gate drive unit GOA to transfer a clock signal transmitted in each clock signal main line 201 to a corresponding gate drive unit GOA. The clock signal main line 201 of the first clock signal line CK1 to the clock signal main line 201 of the Nth clock signal line CKn are provided on one side of the plurality of gate drive units GOA. The N clock signal lines CK may be composed of 4, 8, or 12 clock signal lines, for example, N clock signal lines are composed of CK1 to CK12.

Each gate drive unit GOA is connected to at least one clock signal line CK. Each gate drive unit GOA is used to output a scan signal according to a clock signal input from the clock signal line CK and other signals. The scan signal is loaded into the corresponding scan line to turn on a row of sub-pixels connected to the scan line. The data signal is written into an opened sub-pixel row, and the corresponding sub-pixel row emits light. When the plurality of gate drive units GOA are arranged in the same row and are located on the side of the display area 100*a* of the display panel 100, the scan line S is driven unilaterally. When the plurality of gate drive units GOA are arranged in the same row and are located on both sides of the display area 100*a* of the display panel 100, bilateral driving scan line S is realized. In this embodiment, bilaterally driven scan line S is used. In this embodiment, each gate drive unit GOA is connected to one clock signal line CK. In other embodiments, each gate drive unit GOA may also be connected to multiple clock signal lines CK.

Lengths and widths of the clock signal main lines of the N clock signal lines CK are substantially the same, and the corresponding resistances are also substantially the same. The capacitance formed by the clock signal main line of the N clock signal lines CK and the common electrode Com is basically the same. The difference is that distances between the main lines of the N clock signals and the gate drive unit GOA are different. This results in different lengths of the clock signal branch lines connecting different clock signal main lines and the gate drive unit GOA in the conventional technology. For example, in the conventional technique, the length of the clock signal branch line in the first clock signal line to the length of the clock signal branch line in the Nth clock signal line increases. When the width and thickness of the clock signal branch lines are the same, the resistance of the clock signal branch lines extending from different clock signal main lines is different. Moreover, the capacitance of the capacitor formed by the clock signal branch line extending from different clock signal main lines and the common electrode of the color filter substrate is different. The difference in capacitance and resistance will cause a difference in a falling edge time of the scan signal output by the gate drive unit GOA connected to different clock signal lines. This leads to differences in a charging time of the sub-pixel rows connected to different scan lines, which in turn produces uneven horizontal lines with uneven brightness, causing display issues.

In an embodiment, a capacitance compensation unit 300 is provided on each clock signal line CK. An area of the capacitance compensation unit 300 provided on the first clock signal line CK1 to an area of the capacitance compensation unit 300 provided on the Nth clock signal line CKn increases or decreases. A sum of the area of any clock signal line CK and the area of the capacitance compensation unit 300 provided on the same clock signal line CK is equal to a predetermined area.

In the gate drive circuit 200 of the display panel according to an embodiment of the present application, the capacitance compensation unit 300 is provided on the first clock signal line CK1 to the Nth clock signal line CKn. An area of the capacitance compensation unit 300 provided on the N clock signal lines CK is increased or decreased. This compensates for the difference in area of the N clock signal lines CK, so that the sum of the area of any one of the clock signal lines CK and the area of the capacitance compensation unit 300 provided on the same clock signal line CK is equal to the predetermined area. This makes each clock signal line CK and the capacitance compensation unit 300 provided on the clock signal line CK have the same capacitance as the capacitor formed by the common electrode Com on the color filter substrate 102. This balances a falling edge time of the scan signal output by the gate drive unit GOA connected to the N clock signal lines CK, so that a charging times of the sub-pixel rows connected to different scan lines S are the same. This avoids issues such as dense horizontal lines and uneven brightness caused by different capacitances during display, avoids image quality issues on the 1G1D 8K display panel, and improves display quality.

Specifically, as shown in FIG. 2, multiple gate drive units GOA are arranged in the same column. The number of gate drive units GOA in the same column is greater than N. The first clock signal line CK1 is close to the plurality of gate drive units GOA. The Nth clock signal line CKn is away from the plurality of gate drive units GOA. The gate drive unit GOA1 is connected to the first clock signal line CK1. The gate drive unit GOA2 is connected to the second clock signal line CK2. The gate drive unit GOAn is connected to the Nth clock signal line CKn. The gate drive unit GOAn+1 is connected to the first clock signal line CK1. The gate drive unit GOAn+2 is connected to the second clock signal line. The gate drive unit G2n is connected to the Nth clock signal line CKn. A group of twelve gate drive units GOA is connected in sequence to the first clock signal line CK1 to the Nth clock signal line CKn. The clock signal main line 201 of the first clock signal line CK1 to the clock signal main line 201 of the Nth clock signal line CKn are sequentially provided on one side of the plurality of gate drive units GOA. The clock signal main line 201 of the first clock signal line CK1 is provided close to the plurality of gate drive units GOA. The clock signal main line 201 of the Nth clock signal line CKn is disposed away from the plurality of gate drive units GOA.

In an embodiment, the area of the capacitance compensation unit 300 provided on the first clock signal line CK1 to the area of the capacitance compensation unit 300 provided on the Nth clock signal line CKn decreases. This compensates for the difference in area of the N clock signal lines. The predetermined area is equal to the area of the Nth clock signal line CKn. That is, the area of the capacitance compensation unit 300 provided on the Nth clock signal line CKn is 0, so that the predetermined area is minimized. This minimizes the capacitance values of the capacitors formed by the N clock signal lines CK and the capacitor compensation unit 300 provided on the clock signal line CK and the common electrode Com provided on the color filter substrate 102. This reduces influence on a falling edge time of the scan signal output by the gate drive unit GOA connected to the clock signal line CK and shortens a delay when the scan signal is output to the scan line S. The capacitance compensation unit 300 is disposed on the clock signal branch line 202 of each clock signal line CK. The area of the capacitance compensation unit 300 provided on the clock signal branch line 202 of the first clock signal line CK1 to the area of the capacitance compensation unit 300 provided on the clock signal branch line 202 of the Nth clock signal line CKn decreases. This compensates for the area difference of the clock signal branch line 202 of the N clock signal lines CK.

In an embodiment, each gate drive unit GOA has at least one blank area. The capacitance compensation unit 300 on the clock signal line CK connected to each gate drive unit GOA is disposed in a blank area of the corresponding gate drive unit GOA to save layout space. Because the blank area of the gate drive unit GOA is not provided with a conductive film layer, electrical signals between the gate drive unit GOA and the capacitance compensation unit 300 can be prevented from mutual interference. The area of the blank area is larger than the area occupied by the capacitance compensation unit 300 to further avoid mutual interference of electrical signals between the gate drive unit GOA and the capacitance compensation unit 300. It should be noted that each gate drive unit GOA includes multiple thin film transistors, capacitors, and other devices. Thin film transistors and capacitors include different conductive layers and insulating layers. The blank area of the gate drive unit GOA refers to an area where no conductive layer is disposed in a layout area of the gate drive unit GOA.

In an embodiment, the capacitance compensation units 300 disposed in the blank areas of the plurality of gate drive units GOA are arranged in the same row, so that influence of the capacitance compensation unit 300 corresponding to the plurality of gate drive units GOA tends to be the same. The capacitance compensation unit 300 is a metal block provided on the same layer as the clock signal line CK and is connected in parallel with the clock signal line CK. The capacitance compensation unit 300 provided on each clock signal line CK may be a single metal block or multiple metal blocks. The metal block may be rectangular, square, elliptical, or irregular, and may be adjusted according to a shape and a size of the blank area of the gate drive unit GOA. Specifically, the metal block is rectangular. A length of the metal block ranges from 40 to 50 microns, and a width thereof ranges from 20 to 30 microns. A width of the clock signal branch line 202 ranges from 8 to 10 microns.

In an embodiment, each gate drive unit GOA includes a wire (not shown). The wire has a pull-up node. A distance between the capacitance compensation unit 300 and the wire is greater than or equal to the predetermined distance to avoid mutual coupling between the capacitance compensation unit 300 and the wire, affecting a potential of the pull-up node and affecting a scan signal output waveform by the gate drive unit GOA. The predetermined distance ranges from 8 to 12 microns, for example, the predetermined distance is 10 microns.

It should be noted that a composition of each gate drive unit GOA is a common design in the art, including, for example, a pull-up circuit, a pull-up control circuit, a pull-down circuit, and a pull-down maintenance circuit. The pull-up circuit, the pull-up control circuit, the pull-down circuit, and the pull-down maintenance circuit are all connected to a pull-up node. The pull-up node is a key node in the gate drive unit, and a potential of this node affects a waveform of the scan signal.

In addition, areas of the capacitance compensation units 300 provided on the plurality of clock signal branch lines 202 extending from the same clock signal line CK are equal. For example, the area of the capacitance compensation unit 300 provided on the clock signal branch line 202 connected to the gate drive unit GOA1 and the area of the capacitance compensation unit 300 on the clock signal branch line 202 connected to the gate drive unit GOAn+1 are equal.

In an embodiment, each clock signal line CK includes a resistance compensation unit 400. Resistance values of any two of the first clock signal line CK1 to the Nth clock signal line CKn are equal. In order to make impedance of the N clock signal lines CK the same, to avoid the difference in the resistance of the N clock signal lines CK and the waveform difference of the scan signal output by the gate drive unit GOA connected to the clock signal line CK. This avoids issues such as horizontal lines at equal intervals when displaying on the display panel.

In an embodiment, a resistance value of the resistance compensation unit 400 in the first clock signal line to a resistance value of the resistance compensation unit 400 in the Nth clock signal line increases or decreases. This compensates for the difference in resistance existing in the conventional first clock signal line to Nth clock signal line. The resistance compensation unit 400 is a wire. The capacitance compensation unit 300 provided on each clock signal line CK is connected between the resistance compensation unit 400 of the same clock signal line CK and the corresponding gate drive unit GOA. The resistance compensation units 400 on the plurality of clock signal lines CK are arranged in the same column in the blank area between the plurality of gate drive units GOA 200 and the clock signal main lines of the plurality of clock signal lines CK. This avoids coupling with the main clock signal lines of the multiple clock signal lines CK. The number of windings included in each resistance compensation unit 400 may be the same. The width and length of a winding can be the same or different.

Figure 3:
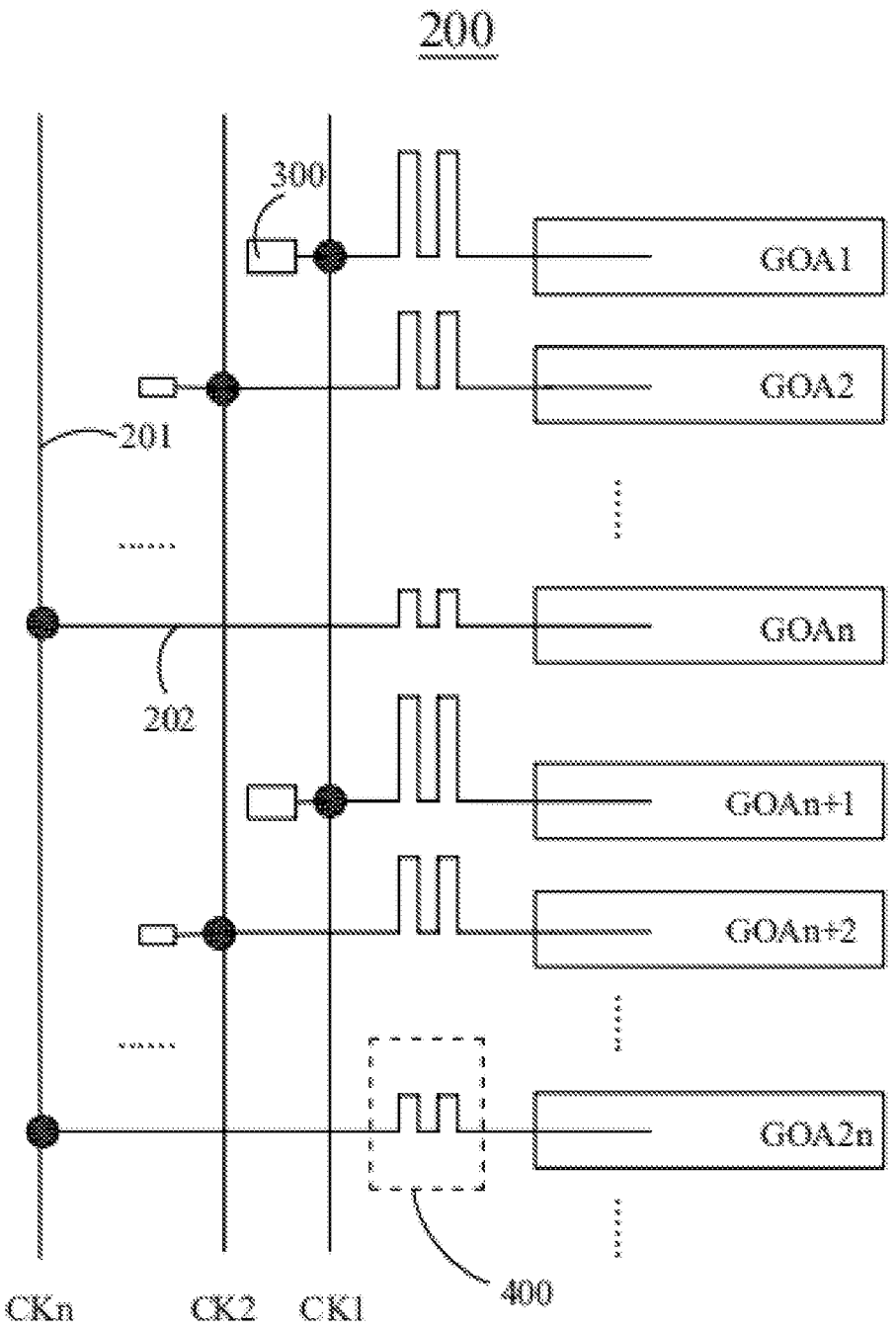
FIG. 3 is a second schematic diagram of the gate drive circuit in the display panel shown in FIG. 1.

Referring to FIG. 3, which is a second schematic diagram of the gate drive circuit in the display panel shown in FIG. 1. The gate drive circuit shown in FIG. 3 is similar to the gate drive circuit shown in FIG. 2. The difference is that the capacitance compensation unit 300 provided on each clock signal line CK is provided between two adjacent clock signal lines CK. This makes full use of space between two adjacent clock signal lines CK and saves layout space. Relative to the capacitance compensation unit 300 disposed in a blank area corresponding to the gate drive unit 300, the capacitance compensation unit 300 disposed between adjacent clock signal lines CK may cause the capacitance compensation unit 300 to be coupled to the clock signal lines on both sides.

Specifically, the capacitance compensation unit 300 provided on each clock signal line CK is located on the clock signal branch line 202 of each clock signal line CK, and is provided between the clock signal main lines 201 of two adjacent clock signal lines CK. In order to make coupling effect of the capacitance compensation unit 300 on the two adjacent clock signal lines CK the same, the capacitance compensation unit 300 is located in the middle of the clock signal main line 201 of the two adjacent clock signal lines CK. The two adjacent clock signal lines CK may include the same clock signal line where the capacitance compensation unit 300 is provided.

It should be noted that, because the capacitance compensation unit 300 and the clock signal line CK provided on the N clock signal lines CK are all connected in parallel, after the capacitance compensation unit 300 is provided, the clock signal line CK and a resistance value of the capacitance compensation unit 300 are less affected.

The descriptions of the above embodiments are only used to help understand the technical solutions and core ideas of the present application. Those of ordinary skill in the art should understand that they can still modify the technical solutions described in the foregoing embodiments, or equivalently replace some of the technical features. However, these modifications or substitutions do not deviate from the scope of the technical solutions of the embodiments of the present application.

What is claimed is:

1. A gate drive circuit, comprising:

N clock signal lines and a plurality of gate drive units;

wherein the N clock signal lines comprise a first clock signal line to an Nth clock signal line sequentially arranged on a side of the plurality of gate drive units, each of the gate drive units is connected to at least one of the clock signal lines;

wherein each of the clock signal lines is provided with a capacitance compensation unit, an area of the capacitance compensation unit provided on the first clock signal line to an area of the capacitance compensation unit provided on the Nth clock signal line decreases, and N is an integer greater than or equal to 2;

wherein each of the clock signal lines comprises a resistance compensation unit, and resistance values of any two of the clock signal lines from the first clock signal line to the Nth clock signal line are equal.

2. The gate drive circuit according to claim 1, wherein a predetermined area is equal to an area of the Nth clock signal line, the first clock signal line is close to the plurality of the gate drive units, and the Nth clock signal line is away from the plurality of gate drive units.

3. The gate drive circuit according to claim 1, wherein each of the gate drive units has at least one blank area, and the capacitance compensation unit on the clock signal line connected to each gate drive unit is disposed in the blank area of a corresponding gate drive unit.

4. The gate drive circuit according to claim 3, wherein the plurality of the gate drive units are arranged in the same row, and the capacitance compensation units provided in the blank area in the plurality of gate drive units are arranged in the same row.

5. The gate drive circuit according to claim 3, wherein each of the gate drive units comprises a wire, the wire has a pull-up node, and a distance between the capacitance compensation unit and the wire is greater than or equal to a predetermined distance.

6. The gate drive circuit according to claim 5, wherein the predetermined distance is 10 microns.

7. The gate drive circuit according to claim 1, wherein the capacitance compensation unit is a metal block disposed in the same layer as the clock signal line and connected in parallel with the clock signal line.

8. The gate drive circuit according to claim 1, wherein a resistance value of the resistance compensation unit in the first clock signal line to a resistance value of the resistance compensation unit in the Nth clock signal line increases or decreases.

9. The gate drive circuit according to claim 1, wherein each of the clock signal lines comprises a clock signal main line and at least one clock signal branch line extending from one of the clock signal main lines, each of the clock signal branch line is connected between one of the clock signal main lines and one of the gate drive units, the clock signal main line of the first clock signal line to the clock signal main line of the Nth clock signal line are sequentially disposed on a side of the plurality of gate drive units, and each of the clock signal branch lines is provided with the capacitance compensation unit.

10. A display panel, comprising:

an array substrate, wherein the display panel has a non-display area, a portion of the non-display area corresponding to the array substrate is provided with a gate drive circuit, and the gate drive circuit comprises N clock signal lines and a plurality of gate drive units;

wherein the N clock signal lines comprise a first clock signal line to an Nth clock signal line sequentially arranged on a side of the plurality of gate drive units, each of the gate drive units is connected to at least one of the clock signal lines;

wherein each of the clock signal lines is provided with a capacitance compensation unit, an area of the capacitance compensation unit provided on the first clock signal line to an area of the capacitance compensation unit provided on the Nth clock signal line decreases, and N is an integer greater than or equal to 2;

wherein each of the clock signal lines comprises a resistance compensation unit, and resistance values of any two of the clock signal lines from the first clock signal line to the Nth clock signal line are equal.

11. The display panel according to claim 10, wherein a predetermined area is equal to an area of the Nth clock signal line, the first clock signal line is close to the plurality of the gate drive units, and the Nth clock signal line is away from the plurality of gate drive units.

12. The display panel according to claim 10, wherein each of the gate drive units has at least one blank area, and the capacitance compensation unit on the clock signal line connected to each gate drive unit is disposed in the blank area of a corresponding gate drive unit.

13. The display panel according to claim 12, wherein the plurality of the gate drive units are arranged in the same row, and the capacitance compensation units provided in the blank area in the plurality of gate drive units are arranged in the same row.

14. The display panel according to claim 12, wherein each of the gate drive units comprises a wire, the wire has a pull-up node, and a distance between the capacitance compensation unit and the wire is greater than or equal to a predetermined distance.

15. The display panel according to claim 14, wherein the predetermined distance is 10 microns.

16. The display panel according to claim 10, wherein the capacitance compensation unit is a metal block disposed in the same layer as the clock signal line and connected in parallel with the clock signal line.

17. The display panel according to claim 10, wherein a resistance value of the resistance compensation unit in the first clock signal line to a resistance value of the resistance compensation unit in the Nth clock signal line increases or decreases.

18. The display panel according to claim 10, wherein each of the clock signal lines comprises a clock signal main line and at least one clock signal branch line extending from one of the clock signal main lines, each of the clock signal branch line is connected between one of the clock signal main lines and one of the gate drive units, the clock signal main line of the first clock signal line to the clock signal main line of the Nth clock signal line are sequentially disposed on a side of the plurality of gate drive units, and each of the clock signal branch lines is provided with the capacitance compensation unit.

* * * * *